US005937713A

United States Patent [19]

Walters

[11] Patent Number: 5,937,713

[45] Date of Patent: Aug. 17, 1999

[54] TOOL FOR OPENING A DOOR WITH ENGAGED SWING BAR GUARD

[75] Inventor: David Walters, Columbus, Ohio

[73] Assignee: Walmas Technologies, Inc., Columbus, Ohio

[21] Appl. No.: 09/003,849

[22] Filed: Jan. 7, 1998

[51] Int. Cl.[6] ..... B25B 27/00

[52] U.S. Cl. ..... 81/15.9; 81/488

[58] Field of Search ..... 81/15.9, 488; 29/270, 29/426.1, 426.5

[56] References Cited

U.S. PATENT DOCUMENTS

| | | | |
|---|---|---|---|
| 4,048,873 | 9/1977 | Stevens | 81/15.9 |
| 4,561,271 | 12/1985 | Scharboneau | 81/488 |
| 5,018,415 | 5/1991 | Hawley | 81/488 |

*Primary Examiner*—David A. Scherbel
*Assistant Examiner*—Joni B. Danganan
*Attorney, Agent, or Firm*—Mueller and Smith, L.P.A.

[57] ABSTRACT

A tool for disengaging the swing bar from a swing bar guard assembly engaged on an entry door to a room where such disengagement is from outside of the room. The tool is formed from an elongate relatively flat shaft having a proximal handle end and a swing bar guard disengaging distal end. The tool has a centrally-disposed generally right-angle Z-bend for accommodating a door stop so that the distal end can be located inside the room when the door is shut. The distal end is centrally hinged to form an outer distal segment and an inner distal segment. The distal end also is biased to rotate the outer distal segment out of alignment with the inner distal segment. The tip of the outer distal segment retains an upstanding rod for contacting the swing bar of the swing bar guard. The inner distal segment retains a trigger mechanism which holds the inner and outer distal segments in alignment and which is actuable by the action of the door closing to release the biased outer distal segment to rotate about its hinge, whereby the upstanding rod can disengage the swing bar. The corresponding method for disengaging the swing bar from a swing bar guard assembly engaged on an entry door to a room, where such disengagement is from outside of the room, includes inserting the tool into a partly open door and closing the door to activate a trigger mechanism on the tool to disengage the swing bar of the swing guard assembly.

5 Claims, 4 Drawing Sheets

TOOL FOR OPENING A DOOR WITH ENGAGED SWING BAR GUARD

CROSS-REFERENCE TO RELATED APPLICATIONS

None

STATEMENT REGARDING FEDERALLY SPONSORED RESEARCH

Not applicable.

BACKGROUND OF THE INVENTION

The present invention generally relates to door swing bar guards which become engaged unintentionally and more particularly to a tool for disengaging such bar guards.

Hotel rooms often have swing bar guard mechanisms installed in their rooms. Swing bar guard mechanisms (see FIGS. 5 and 6) consist of a fixed rod most often affixed to a door and which has an enlarged end. Affixed to the door jamb adjacent the fixed rod is a moveable slotted swing arm which has an enlarged entrance adjacent the door jamb and into which the enlarged fixed rod end fits. The remaining slot is of a size which prevents the fixed rod end from being freed from the slotted arm. This arrangement permits the occupant of the room to open the door but a few inches to greet anyone outside of the door, but prevents entry of that person into the room. The fixed rod cannot be removed from the slotted arm without closing the door because of the location of the enlarged entry in the slot.

Such a swing mechanism can become loose after a period of use. When the door is shut hard or slammed, it is not unusual for the swing bar guard to swing into position; thus, locking everyone out of the room. For example, this is not an unusual occurrence when maids clean the rooms. Maintenance workers must then cut the guard with a saw through the partially opened door as a key no longer will gain access to the room.

U.S. Pat. No. 5,018,415 discloses an unlatching device for disengaging swing arm latches of the type addressed by the present invention. This device is disclosed to be a thin piece of metal with two finger-like prongs at one end and a series of bends to accommodate the door stop. U.S. Pat. No. 2,344,696 is directed to a device to unlatch wing glass latches on automobiles. It does not appear to be useful for swing bar latches. U.S. Pat. No. 4,048,873 is directed to a device for opening chain locks on doors. Again, it does not appear to be useful for swing bar latches.

It is apparent that there is a need for a swing bar guard tool which can be used to unlatch the swing bar guard from the outside of the room when the swing bar guard becomes engaged accidentally or when an emergency in the room exists and it cannot be disengaged. The present invention addresses such need.

BRIEF SUMMARY OF THE INVENTION

The present invention is directed to a tool for disengaging the swing bar from a swing bar guard assembly engaged on an entry door to a room where such disengagement is from outside of the room. The inventive tool is formed from an elongate relatively flat shaft having a proximal handle end and a swing bar guard disengaging distal end. The tool has a centrally-disposed generally right-angle Z-bend for accommodating a door stop so that the distal end can be located inside the room when the door is shut. The distal end is centrally hinged to form an outer distal segment and an inner distal segment. The distal end also is biased to rotate the outer distal segment out of alignment with the inner distal segment. The tip of the outer distal segment retains an upstanding rod for contacting the swing bar of the swing bar guard. The inner distal segment retains a trigger mechanism which holds the inner and outer distal segments in alignment and which is actuable by the action of the door closing to release the biased outer distal segment to rotate about its hinge, whereby the upstanding rod can disengage the swing bar.

The corresponding method is for disengaging the swing bar from a swing bar guard assembly engaged on an entry door to a room, where such disengagement is from outside of the room. Such method includes inserting the novel tool into a partly open door and closing the door to activate a trigger mechanism on the tool to disengage the swing bar of the swing guard assembly.

Advantages of the present invention include a tool that is effective in disengaging engaged swing bar guard assemblies from outside of a room. Another advantage is that the tool does not damage either the door, the door jamb, or the swing bar guard assembly itself. A further advantage is that the tool is actuated by the closing of the door. A yet further advantage is that the tool is simple to use. These and other advantages will become readily apparent to those skilled in the art based on the disclosure set forth herein.

BRIEF DESCRIPTION OF THE DRAWINGS

For a fuller understanding of the nature and objects of the present invention, reference should be had to the following detailed description taken in connection with the accompanying drawings in which.

DETAILED DESCRIPTION OF THE INVENTION

Figure 5:
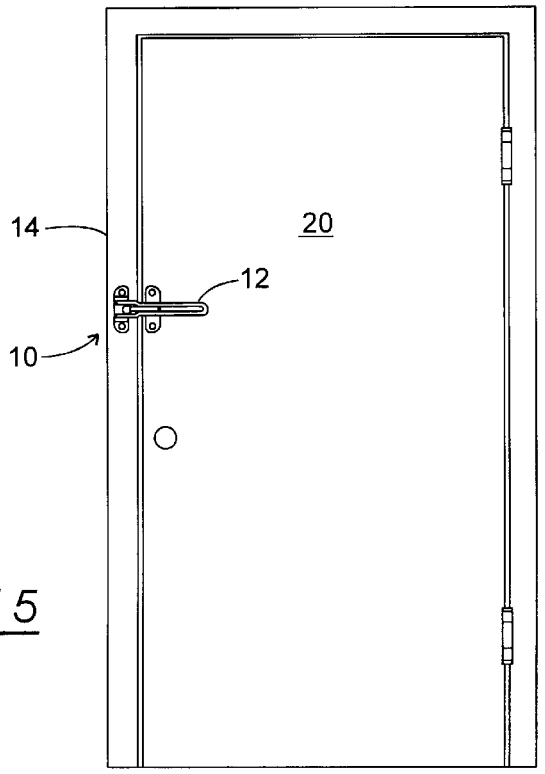
FIG. 5 is a view of the inside of a door and associated frame with a swing bar guard assembly in its engaged position.
Figure 6:
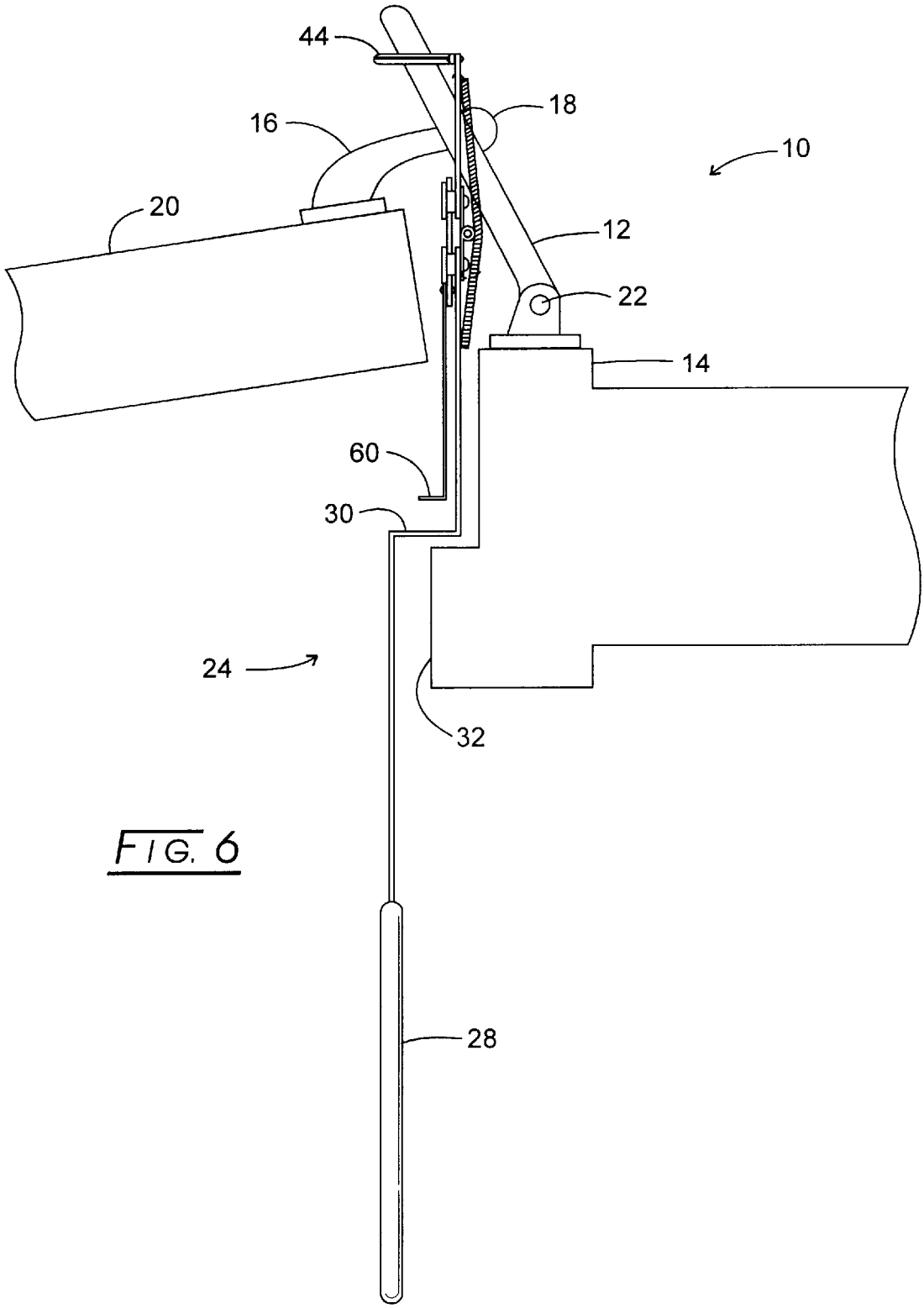
FIG. 6 is an enlarged overhead view of the inventive tool being inserted into the partially open door depicted in FIG. 5.

Swing bar guard mechanism 10 is seen in detail in FIG. 6 to include swing bar 12 which has an elongate slot that flares adjacent its point of attachment (see FIG. 5) to door jamb 14, and fixed rod 16 which is angled towards slotted swing bar 12 so that its knobbed head 18 is located at the flared end of slotted swing bar 12 when door 20 is closed and concomitant therewith slotted swing bar 12 can be rotated about pivot 22 to disengage swing bar guard mechanism 10 so that door 20 can be fully opened. It will observed that engagement and disengagement of mechanism 10 can only occur when door 20 is fully closed because such door condition is necessary for knob 18 to be located in the flare of slotted swing bar 12 whereat knob 18 can be inserted and withdrawn. The remainder of the slot in swing bar 12 is narrower and of a size that precludes knob 18 from being either inserted to removed therefrom; thus, the safety and security feature of mechanism 10.

It also will be appreciated that door 20 can be opened but a few inches when mechanism 10 is actuated, such distance being determined by the length of the slot in slotted swing bar 12. This small opening of door 20, while providing safety and security to the room's occupants, precludes disengagement of mechanism 10 even when its disengagement is desired by the room's occupant(s), e.g., when mechanism 10 becomes accidentally or inadvertently actuated and the room is empty of occupants, when a medical condition of a room occupant makes disengagement of mechanism 10 beyond the capability of the injured or medically ill occupant, etc. It is this necessity that door 20 being ostensibly fully closed before mechanism 10 can be disengaged that causes so many problems in designing a tool which can open mechanism 10 from the outside.

Figure 1:
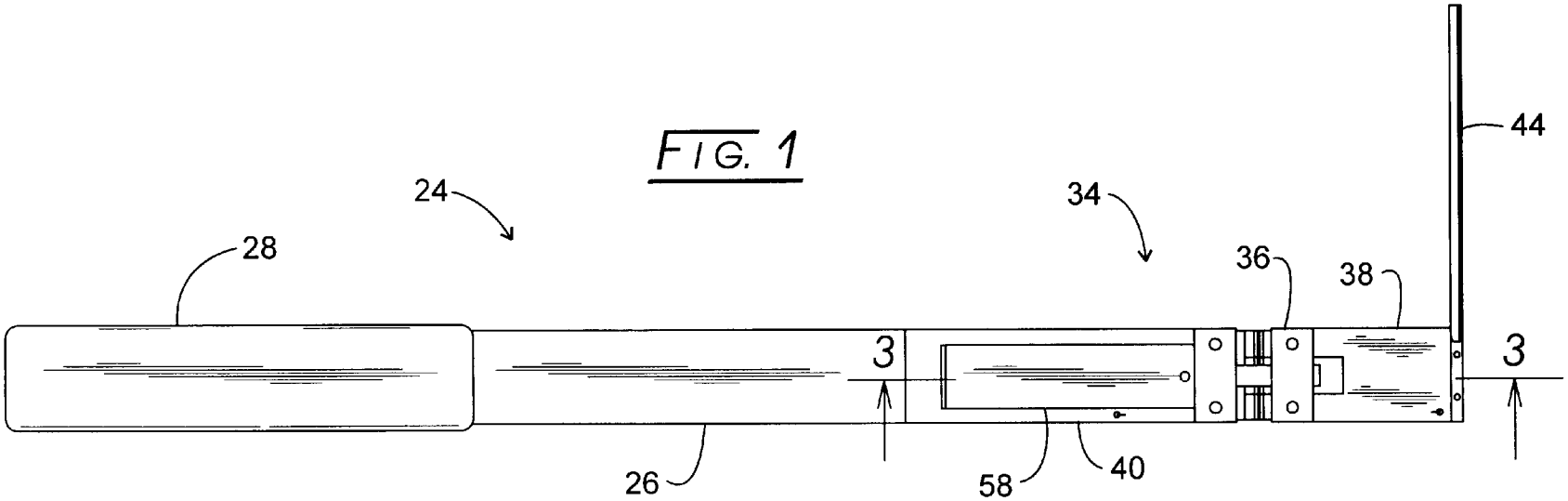
FIG. 1 is an overhead plan view of the inventive tool.

Just such a tool is the subject of the present invention. Referring initially to FIG. 1, tool 24 is seen to include elongate flat shaft 26 which has proximal handle end 28 which suitably can be cushioned with plastic, foam, or like material for easy grasping by an operator. Tool 24 preferably is made from metal, such as, for example, aluminum, steel, stainless steel, or like, thus the preference for handle 28 to be cushioned. Shaft 26 has a generally right angle Z-bend 30 for accommodating door stop 32 (see FIG. 6). In this regard, tool 24 can be used on either a right hand or a left hand opening door. Z-bend 30 desirably is disposed at about the middle of tool 24; although, this location is for convenience only and the proportion of tool 24 devoted to handle 28 and Z-bend 30 can be varied as is necessary, convenient, or desirable.

Figure 2:
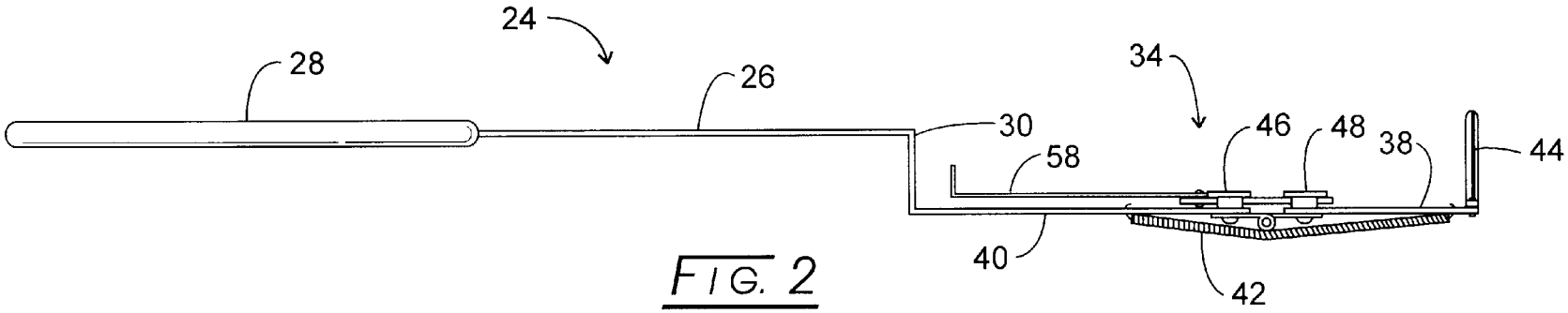
FIG. 2 is a side elevational view of the inventive tool.
Figure 3:
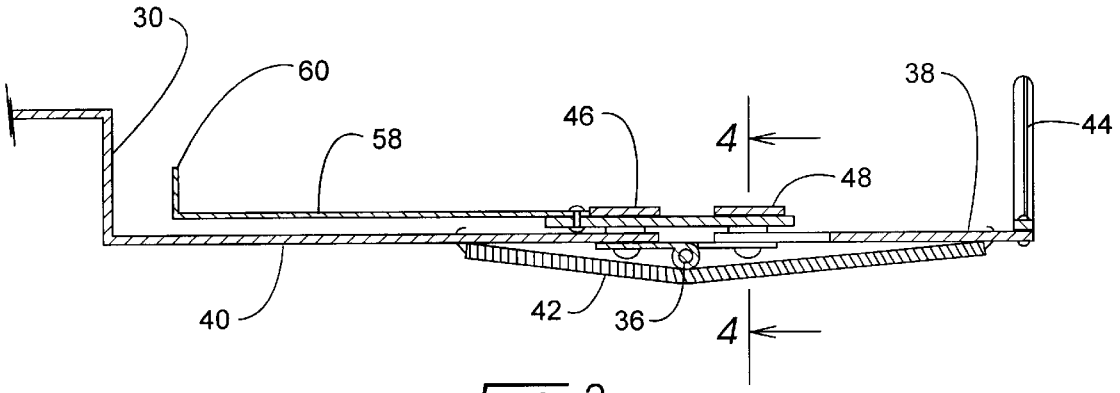
FIG. 3 is a sectional view taken along line 3—3 of FIG. 1.
Figure 4:
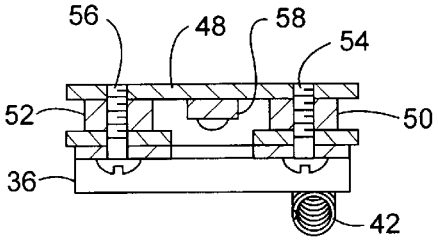
FIG. 4 is a sectional view taken along line 4—4 of FIG. 3.

Of importance in proportioning tool 24 is swing bar guard disengaging distal end 34 which is positioned and proportioned to accommodate swing guard mechanism 10 as described below. Initially, it will observed that distal end 34 is hinged by hinge 36 (see FIG. 4 also) which pivotally connects outer distal segment 38 and inner distal segment 40. Segments 38 and 40 are biasedly connected by spring 42 which can be any type of biasing member as is necessary, desirably, or convenient. As shown in FIG. 2, for example, segment 38 can rotate about hinge 36 in a downwardly direction or in the direction of the location of spring 42. Segment 38 is terminated by upstanding rod member 44 whose action when segment 38 is rotated by spring 42 about hinge 36 is used to disengage slotted swing arm 12, as will be described in detail below.

Referring again to FIGS. 2 and 4, cross-members 46 and 48 run transverse to the elongate axis of segments 40 and 38, respectively, and are maintained spaced apart from segment 40 by spacers 50 and 52, and from segment 38 by spacers not fully shown in the drawings. Spacers 50 and 52 can be nuts which screw onto bolts 54 and 56, respectively, with cross-member 48 being brazed, for example, to bolts 54 and 56. Lever 58 is designed and configured so as to have its distal end inserted into the slots created by cross-members 46 and 48 being in spaced-apart relationship from segments 38 and 40. Lever 58, when so inserted, prevents segment 38 from being rotated about hinge 36 by spring 42 and, thus, becomes a lock for such movement. At this point in the description, it should be evident that the construction about cross-member 46 is the same as that described in connection with cross-member 48. Further in this regard, it will be apparent that a variety of constructions can be used to join segments 38 and 40, biasly hinge these segments, and provide a trigger (lever 58) which holds these segments in alignment but which can be actuated to release segment 38 to be free to rotate about hinge 36 caused by spring 42's pulling action on segment 38 because of the grasping of handle 28 by the tool operator.

Figure 7:
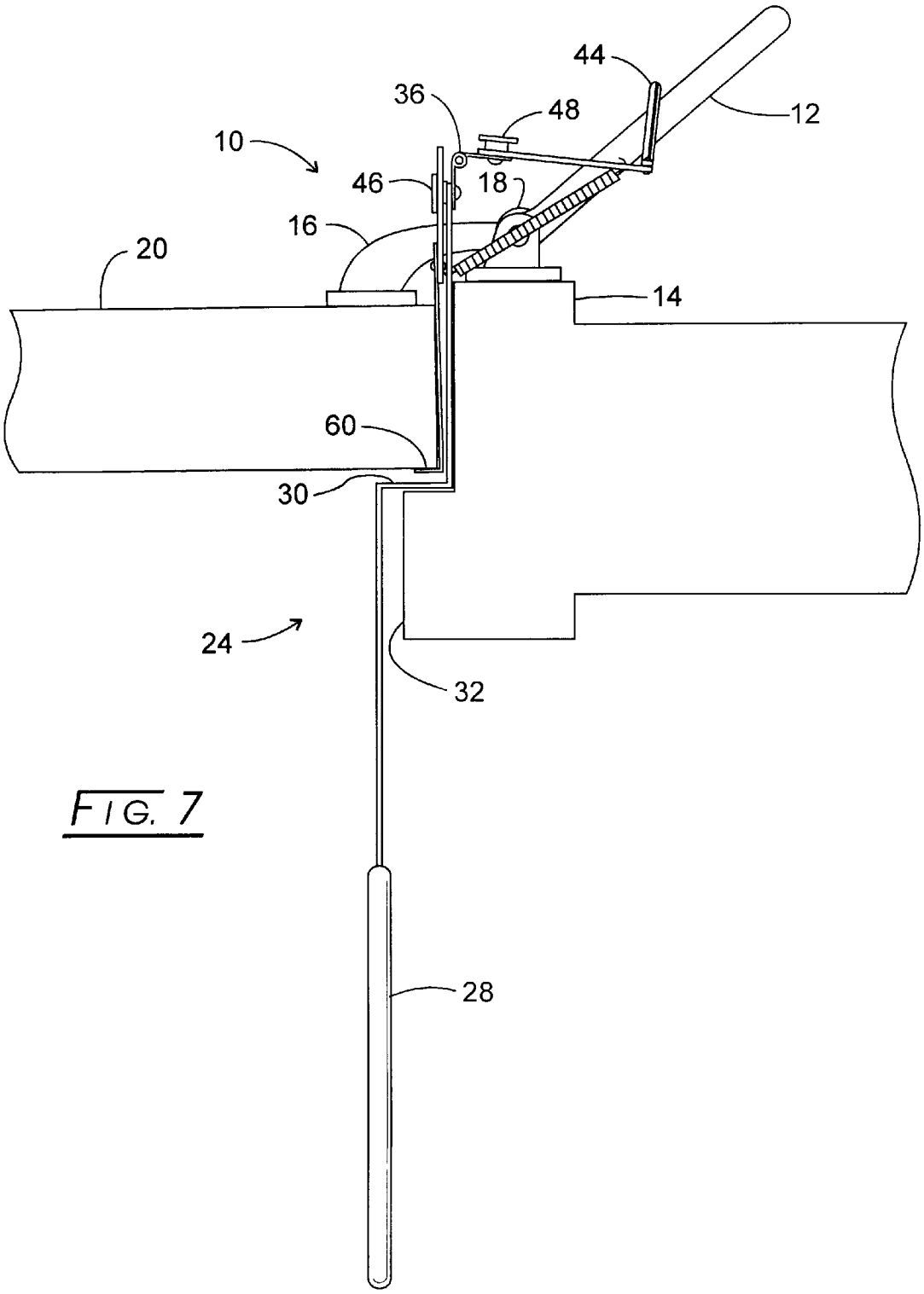
FIG. 7 is the enlarged overhead view of FIG. 6 with the door shut to actuate the inventive tool to disengage the swing bar of the swing bar guard mechanism.

Now, lever 58 has its proximal end terminated by upstanding end 60 which serves as the trigger for moving lever 58 to actuating movement of segment 38. Referring to FIGS. 6 and 7, it will observed that when mechanism 10 is locked and door 20 is opened slightly, tool 24 can be inserted into the door opening with Z-bend 30 conforming to door stop 32. Upstanding rod 44 is placed in contact with the end of slotted swing bar 12. Now, if tool 24 were actuated at this time and in the configuration as depicted in FIG. 6, rotation of slotted swing bar 12 would not disengage mechanism 10 because knob 18 cannot reach the flare in the slot for its removal from the slot. Thus, in order to place mechanism in a condition so that knob 18 can be placed in the flare of the slot of bar 12, door 20 is closed which causes door 20 to engage end 60 of lever 58 and move it towards Z-bend 30. As shown in FIG. 7, movement of lever 58 removes it from cross-bars 46 and 48 which means that spring 42 pulls segment 38 about hinge 36. Movement of segment 38 causes rod 44 to rotate about hinge 36 and, because of its contact with slotted swing bar 12, causes bar 12 to also rotate about its hinge 22. Such rotation of bar 12 places the slot flare at knob 18. Thus, when door 20 now is opened, knob 18 gently is released from being engaged by slotted swing bar 12 and, thus, door 20 can now be opened fully to gain access into the room. It will be observed that the tool will function in both a right and a left opening door because rod 44 can be placed in an upward or a downward position to engage slotted swing arm 12. It is truly unique that tool 24 is activated by the closing of door 20 so that mechanism 10 can be placed into a disengagement configuration.

It will be appreciated that a variety of changes and enhancements to the present invention can be made based upon the precepts disclosed herein, and such changes and enhancements are included within the scope of the present invention as embodied in the following claims.

I claim:

1. A tool for disengaging a swing bar from a swing bar guard assembly engaged on an entry door to a room, where the swing bar guard assembly includes a slotted swing bar and a fixed knobbed-end rod which rides in the slot of the swing bar, where such disengagement is from outside of the room, which comprises:

an elongate relatively flat shaft having a proximal handle end, a swing bar guard disengaging distal end, and a centrally-disposed generally right-angle Z-bend for accommodating a door stop so that the distal end can be located inside the room when the door is shut, the distal end having a central hinge to form an outer distal segment and an inner distal segment, the distal end also being biased to rotate the outer distal segment out of alignment with the inner distal segment, the tip of the outer distal segment having an upstanding rod for contacting the swing bar of the swing bar guard assembly, the inner distal segment having a trigger mechanism which holds the inner and outer distal segments in alignment and which is actuable by the action of the door closing to release the outer distal segment to rotate about the hinge, whereby the upstanding rod can rotate the swing bar so that the swing bar can be disengaged.

2. The tool of claim 1, wherein the inner and outer distal segments are biased with a spring.

3. The tool of claim 1, wherein the trigger mechanism comprises a pair of cross-bars spaced apart from each of the inner and outer distal segments, and a lever with fits between said cross-bars and said inner and outer distal segments, a proximal end of said lever being bent at an angle with respect to the lever so that the door engages the angled lever end when the door is closed to move the lever and, thus, release the outer distal segment so that the outer distal segment can move by virtue of the spring.

4. The tool of claim 1, wherein said proximal handle end is padded.

5. The tool of claim 1, wherein the tool is made from metal.

* * * * *